US006301876B1

(12) United States Patent
Back et al.

(10) Patent No.: US 6,301,876 B1
(45) Date of Patent: Oct. 16, 2001

(54) NOBLE GAS STORAGE AND FLOW CONTROL SYSTEM FOR ION PROPULSION

(75) Inventors: Dwight Douglas Back, Palm City; Charlie Ramos, Melbourne, both of FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 09/611,263

(22) Filed: Jul. 6, 2000

Related U.S. Application Data

(63) Continuation-in-part of application No. 09/159,387, filed on Sep. 23, 1998.

(51) Int. Cl.[7] ..... F03H 1/00; H05H 1/00
(52) U.S. Cl. ..... 60/202; 62/46.3; 62/48.1
(58) Field of Search ..... 60/202, 203.1, 60/204; 62/46.3, 48.1

(56) References Cited

U.S. PATENT DOCUMENTS

| | | | | |
|---|---|---|---|---|
| 3,159,967 | * | 12/1964 | Webb | 60/202 |
| 3,258,909 | * | 7/1966 | Davis et al. | 60/202 |
| 3,807,657 | * | 4/1974 | Brill | 60/203.1 |
| 4,034,569 | * | 7/1977 | Tchernev | 62/2 |
| 4,756,163 | * | 7/1988 | Garg | 62/48 |
| 4,821,907 | * | 4/1989 | Castles et al. | 62/48.1 |
| 5,005,362 | * | 4/1991 | Weltmer, Jr. et al. | 62/45.1 |
| 5,323,953 | * | 6/1994 | Adderley et al. | 228/157 |
| 5,613,366 | * | 3/1997 | Schoenman | 62/45.1 |
| 5,912,424 | * | 6/1999 | Judkins et al. | 95/143 |
| 5,947,421 | * | 9/1999 | Beattie et al. | 60/202 |

FOREIGN PATENT DOCUMENTS

| | | | | |
|---|---|---|---|---|
| 8-4606 | * | 2/1988 | (JP) . | |
| 4-8873 | * | 1/1992 | (JP) | 60/202 |
| 88/01020 | * | 2/1988 | (WO) | 60/202 |

* cited by examiner

*Primary Examiner*—Ted Kim
(74) *Attorney, Agent, or Firm*—Crowell & Moring LLP

(57) ABSTRACT

This invention provides a noble gas storage and delivery system for ion propulsion using an adsorption bed coupled with a primary storage vessel containing compressed gas or two-phase fluid to control the flow and pressure to a thruster component. The adsorption bed component is lighter weight than conventional flow and pressure control devices, and the system can provide in situ gas cleanup and stable flow from two-phase storage. The use of the adsorption bed allows for independent and isolated operation of multiple thruster components such as refill from the primary storage vessel, throttling, and multiple setpoint flow rates. The pressure and flow is controlled using a flow restrictor and low wattage heat. Flow rates of about 2–50 sccm can be controlled to within about 1.2% or less, and the flow can be throttled by varying the pressure. This noble gas storage and delivery system can be used for earth orbit satellites, and lunar or planetary space missions.

2 Claims, 3 Drawing Sheets

NOBLE GAS STORAGE AND FLOW CONTROL SYSTEM FOR ION PROPULSION

STATEMENT REGARDING CONTINUATION-IN-PART

This application is a continuation-in-part of U.S. application Ser. No. 09/159,387 filed Sep. 23, 1998.

STATEMENT AS TO RIGHTS TO INVENTION MADE UNDER FEDERALLY-SPONSORED RESEARCH AND DEVELOPMENT

The U.S. Government has a paid-up license in this invention and the right in limited circumstances to require the patent owner to license others on reasonable terms as provided for by the terms of contract no. NAS3-99077 awarded by the NASA Lewis Research Center and the Ballistic Missile Defense Organization (BMDO).

BACKGROUND OF THE INVENTION

This invention generally relates to a system and method of storing and controlling the flow of noble gas propellants. This invention specifically relates to a system and process for storing and controlling the flow of noble gas propellants for an ion propulsion system.

Ion propulsion systems are projected to play an increasingly important role for future planetary exploration, and for commercial and military earth orbit satellites. These systems produce larger specific impulses than their chemical thruster counterparts, yielding more efficient, lighter-weight propulsion systems.

Currently, noble gases (e.g., argon, krypton, xenon) are favored propellants for electric or ion propulsion systems, in part, because they are non-corrosive and generally inert. Xenon is popular for such systems because it features (i) a low ionization potential and (ii) a large molecular weight of 131.3 g/mole. These compounds, located in Group VIIIA of the Periodic Table of the Elements, are sometimes referred to as "noble gases" even though they may exist as gas, liquid, or solid.

In present ion propulsion systems, a controlled flow of noble gas (e.g., argon, krypton, xenon) in a gaseous state is delivered at low pressure to a thruster from a compressed gas ("CG") storage vessel. The controlled flow of gas at low pressure (e.g., 20 pounds per square inch gauge ("psig")) from storage at high pressure (e.g., 1200–3000 pounds per square inch absolute ("psia")) is accomplished by a combination of pressure and flow control devices. The volumetric flow rate is generally maintained at between about 2–50 standard cubic centimeters per minute ("sccm") for current satellites. The corresponding mass flow rate for xenon would be approximately 0.2–5 milligrams per second ("mg/s"). Larger flow rates may be required for larger spacecraft or for planetary exploration.

The pressure and flow rate of a noble gas propellant must be controlled in an ion propulsion system to provide stable and repeatable delivery to a thruster. The pressure and flow are typically controlled using combinations of pneumatic valves, solenoid or restrictor valves, expansion volumes, dual solenoid "bang-bang" assemblies, flow restrictors, and heated flow restrictors and plenums. These currently practiced means of regulating pressure and flow can be expensive, are unreliable in the presence of two-phase ("2-P") fluids, are complicated, and can be a source of mechanical system failure since most are comprised of mechanically moving parts. These devices may also consume considerable power. For example, a heated flow restrictor can also consume 100–140 watts of power and some valves must be energized when not in use or on stand-by, which is a majority of the time in current satellites.

Compressed gas storage systems face inherent engineering challenges. First, they simultaneously must maintain high storage pressures while providing a regulated release of gas at lower pressures (e.g., 20 psig to vacuum). Second, as the gas is used and the pressure of the vessel decreases, additional hardware and/or controls must be used to maintain a consistent flow rate. Third, plenum volumes must sometimes be used to store compressed gas at desired pressures to be used by the thruster component, and this hardware may or may not be redundant for multiple or redundant thrusters. For the case in which these plenum volumes are used by more than one thruster, the one or more thrusters are forced to operate at similar thruster feed flow rates. Fourth, the noble gas used in ion propulsion systems are required to be of very high purity. Impurities in the noble gases fed to the thruster can cause erosion, wear or other operational problems in the thruster component.

Another difficulty with compressed gas storage systems arises in space-based applications where the noble gas exists in multiple phases. This is problematic because gas-liquid two-phase systems are difficult to separate in zero-gravity, necessitating separation of the phases, storage tank and plenum heaters, and/or a pre-expansion of the two-phase mixture in order to ensure gaseous delivery to the flow and pressure control devices.

For example, when exposed to the cold temperatures of outer space, compressed xenon gas condenses to a liquid phase resulting in a two-phase system. Xenon has a critical temperature of 290 K which falls in the temperature range experienced by gas storage systems on orbiting satellites, e.g., 90 K to 450 K. The exact range depends, in part, on the insulation and temperature controls employed. If the temperature drops below 290 K in space, the potential exists for coexisting liquid and vapor phases. To mitigate this problem, heaters would have to be used and the location and configuration for such heaters is not trivial in zero- or micro-gravity environments.

A further difficulty is that gas-liquid two-phase systems are unreliable in providing a noble gas to an ion propulsion thruster, which is exacerbated by the sensitivity of ion propulsion systems to propellant flow variations. For example, if liquid enters the flow passageway between the storage vessel and the thruster, it may vaporize to create localized pressure and flow rate increases due to the volume expansion of the liquid to a vapor.

The inventors have also taught the advantages of using an adsorbent as a replacement storage media for compressed gas and two-phase storage of noble gases (U.S. patent application Ser. No. 09/159,387). More specifically, the use of an adsorbent as the primary storage media for a noble gas used in ion propulsion systems can provide less-complex noble gas management and control hardware, reduced storage pressures and stored energy, reduced volumes, and, competitive weights and velocity increments compared with compressed gas and two-phase storage. Overall, however, the storage density of noble gas in a compressed gas or two-phase state is usually superior to noble gas stored on an adsorbent.

The current invention retains some of the weight and storage density advantages associated with the use of compressed gas or two-phase storage of the noble gas as the primary storage media, but teaches the use of adsorbents in combination with the compressed gas or two-phase storage ion propulsion system to (a) simplify and reduce the costs and weight of flow and pressure control hardware, (b) minimize the problems associated with two-phase fluid in a thruster system, (c) provide a means to isolate the primary storage vessel from the thruster components, (d) reduce the number of mechanical parts in a flow and pressure control system, (e) provide a simple means to operate multiple thrusters at multiple flow rates and durations, and (f) provide additional in situ noble gas propellant clean up by adsorbing impurities onto the adsorbent or other catalysts.

SUMMARY OF THE INVENTION

It is, therefore, the purpose of the invention to provide an improved system and method of temporarily storing and then controlling the flow and pressure of noble gases, particularly xenon, for ion propulsion systems using compressed gas or two-phase storage as the primary noble gas storage method. The combination of a compressed gas or two-phase storage system with an adsorbent provides for an overall system that is more reliable and robust, simpler, lighter, and less expensive than currently available flow and pressure control systems used in compressed gas or two-phase storage ion propulsion systems. The invention achieves this purpose, as described below.

In the invented system, a noble gas propellant is stored on an adsorbent bed that is part of a system comprised in part of a vessel containing a larger quantity of noble gas stored as a compressed gas or as a two-phase fluid. In one embodiment, the adsorbent bed is located in a separate vessel which can be separated by a valve or other device from the primary compressed gas or two-phase storage vessel of noble gas. In a second embodiment, the adsorbent is located such that it is in constant contact with the compressed gas or two-phase noble gas fluid in the primary storage vessel. In this latter embodiment, the adsorbent occupies only a fraction of the internal volume of the storage vessel with the adsorbent interposed between the compressed gas or two-phase fluid and the exiting fluid passageway of the vessel.

Preferably, the noble gas propellant is comprised of one or more noble gases, and xenon or krypton are preferred as one of or the sole noble gas included. Mixtures of noble gases, e.g., Xe and Kr, may also be used in this invention.

A fluid passageway is provided, preferably by tubing, between the vessel containing the adsorbent and a thruster component. The thruster component is generally at least one of a main flow thruster, a discharge cathode, and a neutralizing cathode. Desorbed propellant flowing in the passageway from the adsorbent bed must pass through a flow control device before reaching the thruster component. Preferably, at least one filter is arranged between the flow control device and adsorbent bed to prevent adsorbent particles and the like from clogging the flow control device and from being introduced in the propellant stream delivered to the thruster component.

Preferably, the adsorbent is an activated carbon. Activated carbons are adsorbents with large gravimetric storage capacities for noble gases. Typical storage capacities for activated carbons are 0.5–2.0 kilograms Xe per kilogram of activated carbon over the pressure range of about 100–1500 psia. In a bed of adsorbent, such as activated carbon there is also unadsorbed gas located within the void between the adsorbent particles which can result in net noble gas storage capacities of up to about 10 kilograms noble gas per kilogram of adsorbent. The ultimate values depends greatly upon the temperature and pressure of noble gas and adsorbent in equilibrium. Granular, pelletized, powdered, and monolithic activated carbons are preferred. Other suitable adsorbents include molecular sieves or zeolites, carbon molecular sieves, mordenite, silica gel, or activated alumina. Mixtures of adsorbents may also be used, and catalysts may also be added to the adsorbent bed as a physical mixture or impregnated onto the adsorbent as a means to purify the noble gas in situ before being used by the thruster component. For example, nickel on silica can remove impurities from noble gases.

A heating device is provided to desorb the adsorbed noble gas propellant from the adsorbent. The heating device may take a number of forms and may be wholly or partially internal or external to the storage vessel. The heating device may rely on heat conduction, radiation, solar radiation, radioisotope, fluid heat exchange or any other heat source or heating method which can effectively desorb the propellant from the adsorbent. If the heating device is internal to the storage vessel, fins or other extended surface features may be attached to the heating device to spread the heat more evenly throughout the adsorbent bed.

The pressure within the storage vessel wherein the adsorbent is located is controlled, in part, by the heating device which is operated and controlled in conjunction with a pressure, temperature, or flow sensor and a controller. The pressure sensor is operatively associated with the storage vessel storing the adsorbent and may also be internal or external to the storage vessel. The flow sensor may be operatively associated with the storage vessel, the tubing, or thruster component. The temperature sensor is operatively associated with the storage vessel storing the adsorbent and may also be internal or external to the storage vessel.

The pressure reduction and flow control device employed is preferably a porous metal flow restrictor, but may operate by way of porous metal, porous ceramic, orifices, capillary tubes and/or valves. Depending on the type, a restrictor heater connected to the flow restrictor may provide for more accurate control of the propellant flow.

In one embodiment of the invented method of storing and controlling the flow of a noble gas propellant in an ion propulsion system, a noble gas propellant is first adsorbed onto an adsorbent bed from a separate compressed gas or two-phase storage vessel. Second, the compressed gas or two-phase storage vessel is closed off from the adsorbent bed. Third, a heating device is employed to heat and desorb the propellant from the adsorbent bed. The desorption is controlled, in part, by the level of heating supplied by the heating device. In turn, this heating is controlled by a controller in communication with both the heating device and a pressure, temperature, or flow sensor. The desorbed propellant increases the pressure within the storage vessel containing the adsorbent bed. In the fourth step, the propellant is flowed through a passageway toward a thruster component. As the propellant flows through the system, it is filtered to remove particles. Fifth, a flow restrictor device and optional restrictor heater further control the flow rate and reduce the pressure of the propellant delivered to the thruster component. Sixth, once the flowing gas propellant pressure has been reduced, it is then flowed to the thruster component.

In a second embodiment of the invented method of storing and controlling the flow of a noble gas propellant in an ion propulsion system, a noble gas propellant is adsorbed onto an adsorbent bed located in a compressed gas or two-phase storage vessel. The adsorbent occupies only a fraction of the total internal volume of the storage vessel and the adsorbent material is located in such a way so as to require the propellant to pass through it before exiting the storage vessel into the passageway connecting the vessel to the thruster component.

A heating device is employed as in the prior embodiment to heat, desorb, and flow the propellant from the adsorbent bed to the thruster component. In this second embodiment, the heated adsorbent provides noble gas vapor to the passageway connected to the thruster component. The noble gas will be supplied to the thruster in a gaseous phase. This prevents complications arising from storage vessels in space which contain two-phase noble gas. As the storage vessel is depleted of noble gas during its mission, the heated adsorbent bed is used to maintain a constant pressure upstream of the flow restrictor during times for which propellant is needed by a thruster component.

BRIEF DESCRIPTION OF THE DRAWINGS

Other objects, advantages and novel features of the present invention will become apparent from the following detailed description when considered in conjunction with the accompanying drawings herein.

Like reference numbers in the figures refer to like parts.

DETAILED DESCRIPTION OF THE INVENTION

This invention teaches the use of adsorbents in combination with a primary noble gas storage vessel comprised of compressed gas or two-phase fluid to improve the functionality, cost, and weight of the overall system relative to using compressed gas or two-phase fluid alone.

Figure 1:
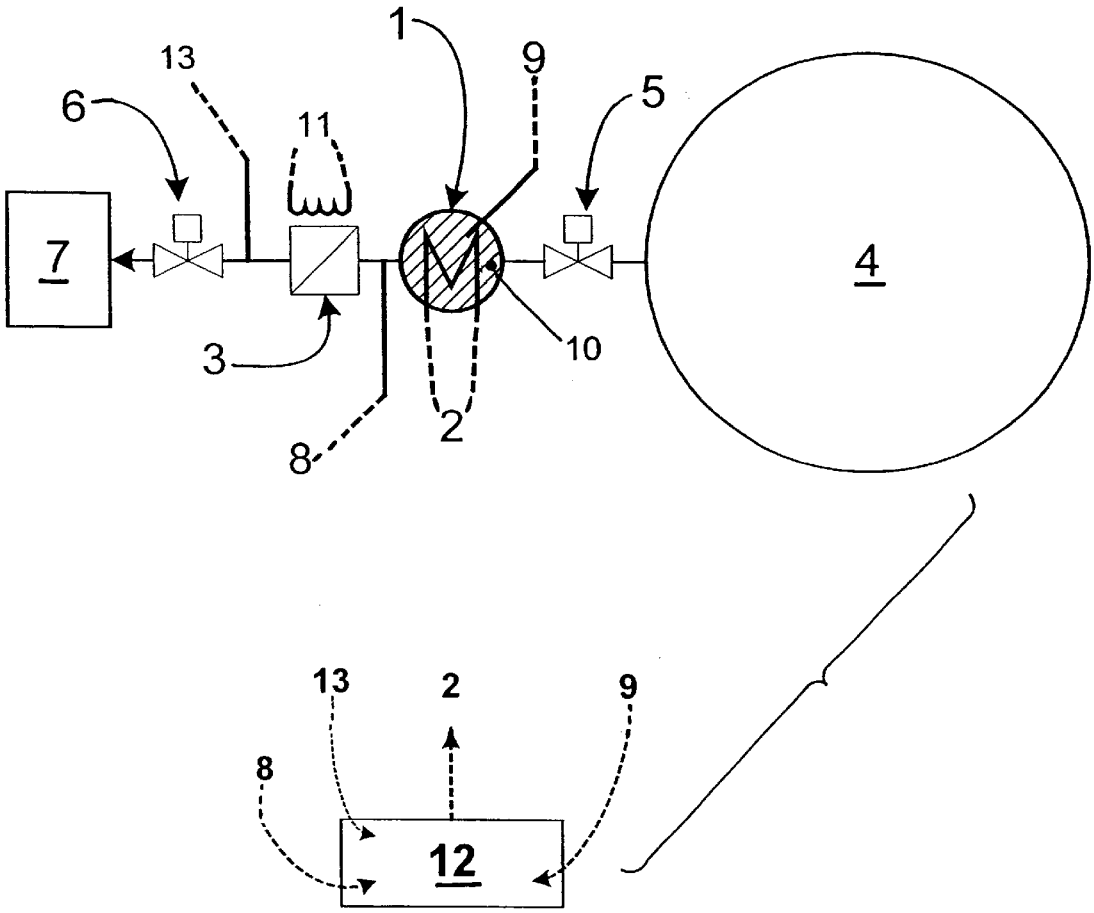
FIG. 1 is a schematic representation of a currently preferred embodiment of this invention with a separate adsorbent bed and compressed gas and two-phase storage vessel.

According to one presently preferred embodiment of the present invention, and as depicted in FIG. 1, a noble gas such as Xe is stored on an adsorbent bed 10 enclosed in a storage vessel 1 which is connected to a larger storage vessel 4 and a flow restrictor 3. A noble gas is adhered to or adsorbed onto the adsorbent 10 enclosed in vessel 1, and the larger vessel 4 contains noble gas in a compressed gas or two-phase state. Valve 5 is located between the adsorbent bed vessel 1 and primary noble gas storage vessel 4. The adsorbent bed 10 is heated by heating device 2, which can be a resistance heater or other source of heat. Optionally, another valve 6 can be used to isolate the thruster component 7 from the adsorbent bed vessel 1 and larger vessel 4 if this isolation is not already inherent to the thruster component itself. The system may also include optional restrictor heater 11 which can further modify the flow rate to thruster component 7 by applying heat to restrictor 3.

Between the larger storage vessel 4 and the flow restrictor 3 there will also be sufficient filters typically having a rated pore size of 0.5 to 10 micrometers to stop the flow of adsorbent particulates or the like into the flow restrictor 3. Similarly, there may be additional filters typically having a rated pore size of 0.5 to 10 micrometers between the flow restrictor 3 and thruster component 7.

According to this currently preferred embodiment, a pressure measuring device 8 will also be located between the larger storage vessel 4 and the flow restrictor 3, and a temperature measuring device 9 will be located within the adsorbent bed 10 of vessel 1 or on the surface of vessel 1. In FIG. 1, the pressure measuring device 8 is shown located between vessel 1 and restrictor 3.

In operation, valve 5 will open and allow communication between the compressed gas or two-phase fluid noble gas in the primary storage vessel 4 and the adsorbent 10 in vessel 1. The mass of noble gas in vessel 4 is denoted as $M_4$. The heating device 2 applies heat to the adsorbent material 10 to increase its temperature, if required. The required temperature of the bed is determined by a relationship between the pressure in vessel 4 and desired amount of noble gas needed for the thruster component 7. That is, for a vessel 4 pressure denoted as $P_4$, and a temperature of the adsorbent denoted as $T_{10}$, there will be one value for the amount of noble gas $m_4$, where $m_4<M_4$, which can be adsorbed onto a mass $m_{10}$ of adsorbent 10. This amount of noble gas removed from vessel 4 and adsorbed onto adsorbent 10 reaches an equilibrium loading of $m_4/m_{10}$. The mass $m_{10}$ of adsorbent is a system design parameter which will be a function of the length of time and flow rate of noble gas needed by the thruster component 7. After the temperature $T_{10}$ has been reached by the heating device 2, valve 5 is closed shutting off the fluid passageway between vessel 4 and vessel 1 containing adsorbent 10. The vessel 4 can now feed other adsorbent vessels 10', 10" (not shown) and thruster components 7', 7" (not shown) in a similar manner and to varying masses $m_4$ of noble gas.

The adsorbent 10 then cools and the pressure $P_{10}$ drops in the adsorbent bed 10. After a predetermined pressure has been reached which is at or below the pressure required to cause the flow rate of noble gas needed by the thruster component, valve 6 or a similar valve within the thruster component opens and noble gas flows from the adsorbent bed 10 through the restrictor 3 to the thruster component. The heating device 2 causes the noble gas to desorb from adsorbent bed 10 and generate a constant gas pressure $P_{10}$. The heating device 2 may be of an internal or an external design. By heating the adsorbent bed 10, the thermodynamic equilibrium inside the vessel 1 is maintained so as to generate gas pressure $P_{10}$ While gas is flowing from the adsorbent bed 10 at constant pressure, the bed temperature $T_{10}$ will increase. As the noble gas flows from the vessel 1 at pressure $P_{10}$ through restrictor 3, the pressure drops to pressure $P_7$. While gas is flowing from the adsorbent bed 10, the temperature, and therefore pressure, of the bed could optionally be increased by controller 12 to increase the flow to higher levels. Similarly, the controller 12 could be shut off with the valve 6 opened to the thruster component to effectively "throttle down" the flow rate to a lower level.

The flowing noble gas is then directed to a thruster component which can be one or more components selected from the group consisting of a main thruster, a neutralizing cathode, and a discharge cathode. After a pre-determined time, valve 6 or a similar valve located within the thruster component 7 is closed and heating device 2 is shut off. The vessel 4 and vessel 1 can then be re-communicated to fill the adsorbent bed again with noble gas at a prescribed $T_{10}$ and $P_4$ which dictates a specific loading of noble gas $m_4$. The above cycle then repeats through the life of the noble gas contained in vessel 4. The approximate number of possible cycles is given by $M_4/m_4$ if $m_4$ is always the same. However, it is not necessary by this invention that $m_4$ is constant.

The temperature $T_{10}$ and, consequently, the pressure $P_{10}$ in storage vessel 10 is adjusted via heating device 2 by a controller 12 which receives feedback from a pressure sensor 8, a flow sensor 13, or a temperature sensor 9 (indicated by arrows from 8 and 9 to 12 in FIG. 1) and causes heat input to heating device 2 (indicated by arrow from 12 to 2 in FIG. 1). Feedback from temperature sensor 9 is generally used when the adsorbent bed 10 is in communication with vessel 4, and feedback from pressure sensor 8 is used when there is no communication with vessel 4. The controller may use proportional, proportional-integral, proportional-integral-derivative (PID), or other linear or non-linear algorithms. The controller 12 may alternatively receive feedback from a flow sensor 13 located downstream of restrictor 3 when the adsorbent bed 10 is not in communication with vessel 4 and noble gas is flowing to the thruster component 7.

Heat input to storage vessel 1 and adsorbent 10 may be generated from electrical resistance elements in internal heating device 2 or by heat pipes, heat conduction through metal, solar radiation, radioisotope sources or fluid heat exchangers. For heat pipes, fluid heat exchangers, or heat conduction through solid materials, the ultimate heat source could be a power processing unit (not shown) or other heat generating equipment present near the ion propulsion system.

Adsorbent vessel 1 may be insulated with insulation to reduce radiative heating of the vessel and contents. Insulation can be multi-layer-insulation (MLI) type, foam insulation, paint, and/or other radiation shielding materials. Insulation also reduces heat losses from adsorbent bed 10 to surroundings when adsorbent bed 10 is heated to generate the appropriate pressure $P_{10}$.

Flow restrictor 3 reduces the pressure and controls the flow from adsorbent bed 10. Flow restrictor 3 is preferably comprised of a sintered porous metal, but may use porous ceramics, orifices, capillary tubes, and valves. Employing restrictor heater 11 is preferred because it can provide increased control of the noble gas flow rate by simply modulating pressure $P_{10}$. Restrictor heater 11 provides increased control of the noble gas flow rate by thermally expanding and contracting the porous metal of the porous metal flow restrictor 3. Since thermal expansion characteristics vary for different materials, the benefits of employing restrictor heater 11 vary. As an example, a 30% reduction in flow rate is achievable using a stainless steel restrictor heated to 100° C. from 25° C.

The heating of restrictor 3 could also change the local viscosity of the flowing gas with sufficient time for heat transfer to noble gas from restrictor 3 and connecting parts. As noble gas viscosity increases with temperature, the flow rate decreases accordingly.

The flow rate through a porous sintered metal flow restrictor 3 may be approximately represented by the equation:

$$V_s(\text{sccm})=a(\sqrt{1+b(P_{10}^2-P_7^2)}-1) \quad [1]$$

where $V_s$ is the flow rate downstream of flow restrictor 3 in sccm, $P_{10}$ is pressure in vessel 1 with adsorbent 10, $P_7$ is pressure downstream of flow restrictor 3, and a and b are constants. This equation serves to illustrate the general relationship which exists between the pressures $P_{10}$ and $P_7$, and the flow rate of noble gas $V_s$. to a thruster component 7.

As understood by those skilled in the art, and according to Equation 1, an increase in pressure $P_{10}$ yields an increase in flow rate $V_s$, and a decrease in $P_{10}$ causes a decrease in $V_s$. The flow rate to thruster component 7 can be controlled by heating vessel 1 and adsorbent bed 10 since pressure $P_{10}$ generally increases as $T_{10}$ increases. Pressure $P_{10}$ in vessel 1 also varies the loading $m_4/m_{10}$. The temperature-pressure relationship can be described by the differential equation:

$$\partial \ln(P_{10}) = -\frac{\Delta H(T_{10}, m_4/m_{10})}{R}\partial\left(\frac{1}{T_{10}}\right) \quad [2]$$

where ΔH is the enthalpy of desorption (greater than zero) and a function of $T_{10}$ and $m_4/m_{10}$; $P_{10}$ is pressure in vessel 1; R is the ideal gas law constant; $m_4$ is the mass of noble gas in vessel 1; $m_{10}$ is the mass of adsorbent 10 in vessel 1; $T_{10}$ is absolute temperature of vessel 1 and adsorbent 10. Equation 2 shows that as the temperature increases, pressure increases non-linearly. The enthalpy of desorption ΔH also generally increases as $m_4/m_{10}$ decreases (i.e., as the bed continues to flow noble gas to the thruster), and ΔH is approximately constant with $T_{10}$ over small temperature ranges.

Figure 2:
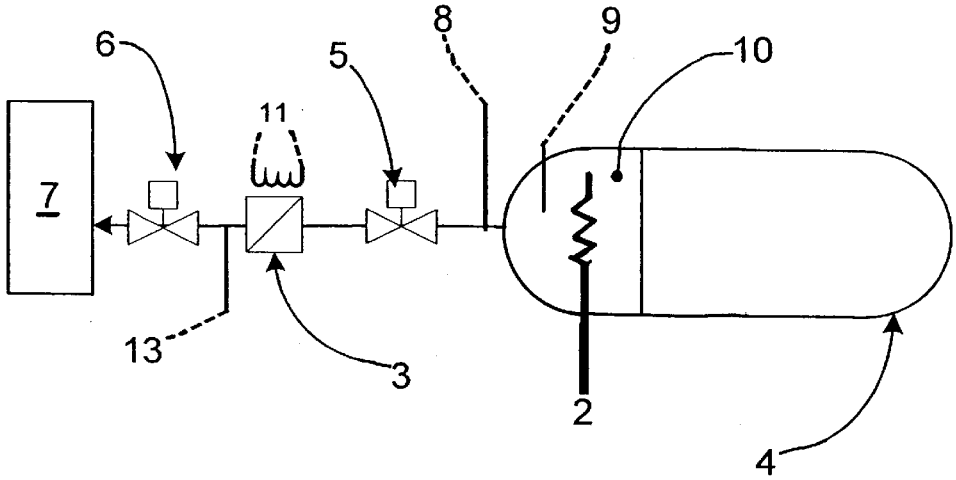
FIG. 2 is a schematic representation of a currently preferred embodiment of this invention with a combined adsorbent bed and compressed gas and two-phase storage vessel.

FIG. 2 represents a second embodiment of this invention whereby the adsorbent bed 10 communicates continuously and directly with the compressed gas or two-phase noble gas fluid in vessel 4. This embodiment differs from the previous in that the adsorbent 10 is now located within vessel 4 and is upstream of valve 5. The adsorbent 10 also is located between the compressed gas or two-phase fluid and valve 5 in such a way so as to require any noble gas exiting vessel 4 necessarily passes through or by absorbent 10 before passing through valve 5. The purpose of this configuration is to provide a source of noble gas to the thruster component 7 which is gaseous and not two-phase, regardless of whether compressed gas or two-phase fluid is stored in vessel 4.

Figure 3:
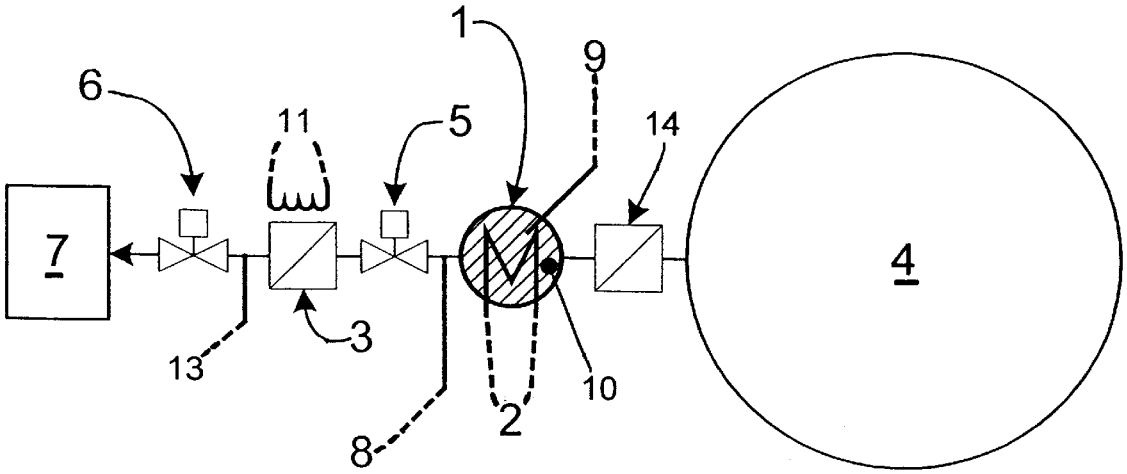
FIG. 3 is a schematic representation of a currently preferred embodiment of this invention with a connected adsorbent bed and compressed gas and two-phase storage vessel.

Adsorbent 10 located within or directly connected to vessel 4 occupies only a small volume relative to the volume occupied by the compressed gas or two-phase fluid in vessel 4. FIG. 2 depicts the adsorbent bed located in the same vessel as where the primary noble gas is stored. Using the adsorbent as a separate vessel from the vessel 4 accomplishes the same function and is depicted in FIG. 3. As depicted in FIG. 3, a second flow restrictor 14 may be located between the adsorbent bed 10 and vessel 4 to reduce the pressure from the vessel 4 prior to reaching the heated adsorbent bed 10.

Heating device 2 serves to heat the adsorbent 10 to a temperature $T_{10}$. Temperature $T_{10}$ is selected through thermodynamic considerations such that the fluid passing through it will be gaseous regardless of its upstream state (e.g., compressed gas or two-phase fluid). This generally implies that $T_{10}$ will be greater than the noble gas critical temperature.

Valves 5 and 6, temperature sensor 9, pressure sensor 8, flow restrictor 3, restrictor heater 11, and thruster component 7 function similarly to that described in the previous embodiment and FIG. 1.

In operation, heating device 2 in FIG. 2 or FIG. 3 heats adsorbent 10 to a temperature $T_{10}$ sufficient to ensure gaseous noble gas, i.e., a temperature above the critical temperature for the noble gas. This temperature will correspond to a thermodynamic equilibrium pressure $P_{10}$ of the noble gas with the adsorbent. Valve 5 and optional valve 6 are then opened and gaseous noble gas flows from the compressed gas or two-phase fluid volume in vessel 4 through the adsorbent bed 10 and then through the restrictor 3 whereby its pressure $P_{10}$ is decreased to $P_7$. The flow rate of noble gas to the thruster component is given by a relationship such as Equation 1 if the restrictor is a porous sintered metal flow restrictor. If two-phase fluid exists in the substantially larger void volume of vessel 4, the liquid noble gas must first pass through the adsorbent bed which is at a temperature above its critical temperature and which will cause the liquid to exist in a gaseous state before passing through valve 5 and onward through restrictor 3. The adsorbent bed temperature $T_{10}$ would usually be controlled by a feedback control loop with a heating device 2, however, there are instances where pressure or flow rate feed back may be more suitable.

The flow process to thruster component is halted by closing valve 5, and optionally valve 6 if present, and deactivating the heating device 2. The system can then be reactivated by supplying heat to heating device 2 and reopening valves 5 and optional valve 6.

The adsorbent 10 taught by this invention is selected from the group consisting of activated carbon, molecular sieve or zeolite, carbon molecular sieve, mordenite, silica gel, or activated alumina. Mixtures of these adsorbents can also be used. In addition, we have found that the addition of small quantities of catalyst, whether as a physical blend with the adsorbent or impregnated into an adsorbent, can provide certain benefits to the overall flow and pressure control system. Namely, catalysts such as nickel on silica ($SiO_2$) can remove impurities commonly found in noble gases that which could cause functional problems with an ion propulsion thruster. Hence, the use of these catalysts with the adsorbent materials 10 can effectively purify the noble gas in situ prior to use in the thruster component 7.

In the described embodiments, one skilled in the art will also recognize that other valves, such as explosive or fill valves or the like, or other temporary isolation devices may be located throughout the system depicted in FIG. 1 and FIG. 2 between thruster component 7 and storage vessel 4 and attached to vessel 4. These are ancillary components common to any ion propulsion noble gas storage and flow and pressure control system.

In the embodiments of FIG. 1 through FIG. 3, the heating device 2, depicted as an electrical resistance heating element in FIG. 1–3, could be replaced by a heat exchanger with a heat exchange fluid or a heat pipe. The heat exchanger fluid could receive heat from a process or device located within the ion propulsion system. For example, a power processing unit produces waste heat which could be utilized in this invention. Similarly, a heat pipe could withdraw heat from other locations in the ion propulsion system and channel this heat to the adsorbent bed 10.

Although pressure sensor 8, temperature sensor 9, or flow sensor 13 feedback control are the preferred method for controlling the noble gas flow rate via heating, the flow rate may be controlled using feedback from thruster component 7 or other devices which generate an electrical signal that is proportional to the flow rate of noble gas.

The heating requirement of adsorbent bed 10 is theoretically, (i.e., with no heat losses) in the range of 0.5–2.0 watts based on the heat of desorption ΔH determined through isotherm measurements at various temperatures for several adsorbents and combined with typical flow rates of approximately 0.2–5 mg/s used in current ion propulsion systems. Because of heat losses due to convection, conduction, and radiation, these power requirements are in practice larger. The heating power requirement "$Q_{tot}$" also increases as the adsorbent bed depletes its noble gas mass $m_4$ since ΔH increases as $m_4/m_{10}$ decreases. This results in higher temperatures $T_{10}$ to maintain a constant $P_{10}$, and higher temperatures $T_{10}$ induce higher heat losses $Q_{loss}$ to the environment at temperature $T_e$. These heating power requirements are summarized by the following equation:

$$Q_{tot}=Q_{loss}+c\ V_s\Delta H \quad [3]$$

Where $V_s$ is the flow rate of noble gas to the thruster component 7, c is an appropriate conversion constant, and $Q_{loss}$ is the heat loss to the environment which increases as $T_{10}$ increases and as $T_e$ decreases.

This temperature $T_e$ will vary depending on the location of the storage vessel and degree of insulation, but in general the temperature should be within a range of 90–450 K for earth orbit, planetary, or space missions.

Figure 4:
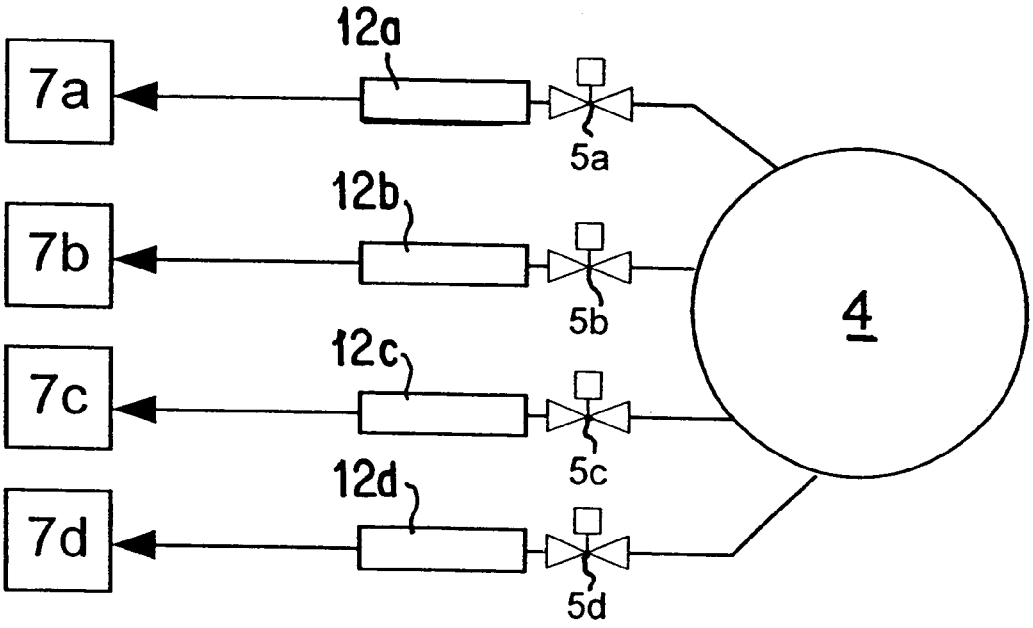
FIG. 4 is a schematic representation of multiple thruster components fed by multiple flow and pressure control subsystems fed from a single compressed gas or two-phase storage vessel.

FIG. 4 illustrates an embodiment of this invention whereby several flow and pressure control subsystems, comprised of items 1–3, 6, and 8–11 in FIG. 1, are attached to a single vessel 4 and valves 5*a*, 5*b*, 5*c*, and 5*d* serving the same function as valve 5 in FIG. 1. The separate flow and pressure control subsystems comprised of items 1–3, 6, and 8–11 in FIG. 1 are collectively labeled as items 12*a*, 12*b*, 12*c*, and 12*d* in FIG. 4. Each of these separate flow and pressure control subsystems then feed a separate thruster component 7*a*, 7*b*, 7*c*, and 7*d*, respectively. This embodiment illustrates the usefulness of this invention to provide independent flow control to various thruster components (e.g., 7*a*–7*d*) while being isolated from the storage vessel 4. Isolation from the storage vessel 4 is useful because it allows the various subsystems (e.g., 12*a*–12*d*) to provide noble gas to a thruster component while another subsystem is being loaded with noble gas from vessel 4. Mishaps or malfunctions in one of the subsystems (e.g., 12*a*–12*d*) also will not affect the operation of the remaining subsystems.

Using the embodiment of FIG. 1, xenon (Xe) flow rates were measured for various porous metal flow restrictors having flow rates ranging from about 2–50 sccm (0.2–5 mg/s). In several experiments, an activated carbon bed was filled from a vessel 4 and then used to supply Xe through a flowmeter. On average, flow rates varied by about 1.2% (one standard deviation) for periods of time ranging from 10 minutes to 7 hours. The variation ranged from ±0.3% to about ±5% depending on the flow rate and the controller setting used. The pressure ($P_{10}$) variation resulting from the PID controller on the system was on average about ±0.48%. In some tests, the Xe was flowed for repeated durations from a single loading from vessel 4, and in other tests the flow period was followed by a re-fill from the vessel which was then followed by another flow period and refill and so on. Xe gas flow rate was also throttled to higher flow rates, e.g., 2.4 to 25 sccm, by increasing the PID control pressure setpoint ($P_{10}$) from 110 to 500 psia, for example. Throttling of the Xe flow rate was also achieved with a different restrictor in the reverse direction by changing the pressure setpoint from 80 to 50 psia resulting in a flow rate decline of 25 to 10 sccm. A typical power requirement for a 2–3 sccm flow rate of Xe was 0.5–3 watts, depending upon the loading $m_4/m_{10}$ and corresponding bed temperature $T_{10}$ for the pressure setpoint $P_{10}$. For higher flow rates, the power requirement increased. At about 7.5, 12.5, and 32 sccm, the power requirements were 3–9 watts, 3–6 watts, and 10–20 watts, respectively. The power requirement is dependent upon the mass of the adsorbent $m_{10}$, mass of the Xe charge on the adsorbent $m_4$, pressure $P_{10}$ and temperature $T_{10}$ as taught by this invention and optimization of these parameters can reduce the power requirement for any given system.

In other examples following the embodiment of FIG. 1, Kr was tested. Using about 30 grams of adsorbent, the flow rate of Kr varied by about 1%–2.5% at a flow rate of 10 sccm and pressure setpoint $P_{10}$ for the adsorbent bed of 160 psia. The bed was refilled between multiple flow cycles by a vessel 4 at about 500 psia. Power requirements were generally around 7–15 Watts.

In further examples using the embodiment of FIG. 1, a 120 gram adsorbent bed was used to deliver argon (Ar). Repeated 10 minute flow cycles from this bed were performed at 30 sccm with a variation of about 1%.

Using the embodiment of FIG. 3, a vessel of Xe at 500 psia and room temperature was cooled to −44° C. (229 K). At this temperature, the Xe contained in the vessel 4 was two-phase since the vapor pressure of Xe at this temperature is about 200 psia. The adsorbent bed 10 was heated by a resistance heater 2 and maintained at a controlled temperature of 35° C. or 308 K (i.e., above the 290 K critical point of Xe). Valves 5 and 6 were opened and the Xe was allowed to flow through a flow meter. The flow rate for this particular restrictor 3 was about 6.5 sccm with a variation of about 1.4% for 90 minutes of operation.

For comparison, the weight for one example Xe flow and pressure control system as depicted by FIG. 1 is 1,876 grams. This system includes a composite primary storage vessel having an internal volume of 1100 cubic centimeters, a pressure transducer, a thermocouple, an adsorbent storage vessel with internal finned surface area, resistance heater, and insulation, a sintered metal flow restrictor, filters, miscellaneous tubing and fittings, a service valve and two latch valves. Equivalent conventional Xe flow control devices weight about 10–100% more.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof. Also, the phraseology and terminology employed herein are for description and not limitation.

What is claimed is:

1. A method for storing and delivering a noble gas propellant in an ion propulsion system, comprising the steps of:

(a) opening a flow passageway between an adsorbent storage vessel containing an adsorbent and a primary storage vessel;

(b) allowing a noble gas propellant comprising at least one noble gas to flow from the primary storage vessel onto the adsorbent in the adsorbent storage vessel;

(c) closing the flow passageway between the adsorbent storage vessel and primary storage vessel;

(d) desorbing the noble gas propellant from the adsorbent in an adsorbent storage vessel by heating, thereby increasing a pressure within the storage vessel;

(e) flowing a quantity of the noble gas propellant from the adsorbent storage vessel;

(f) reducing the pressure of the quantity of the noble gas propellant with a porous metal flow restrictor, heating the porous metal flow restrictor to increase a control of a flow rate of the noble gas propellant; and (g) flowing the quantity of the noble gas propellant to a thruster component.

2. A noble gas storage and delivery system for ion propulsion, comprising:

an adsorbent storage vessel containing an adsorbent for adsorbing a noble gas propellant, wherein the noble gas propellant comprises at least one noble gas;

a primary storage vessel containing noble gas propellant operatively connected to the adsorbent storage vessel;

an isolation valve and a pressure reduction device operatively associated with the adsorbent storage vessel, wherein the pressure reduction device is a porous metal flow restrictor;

a restrictor heater connected to and for heating the pressure reduction device, wherein a control of a noble gas propellant flow rate is increased;

at least one filter operatively connected between the storage vessel and the isolation valve;

a heating device for heating the absorbent;

a pressure sensor operatively associated with the storage vessel, for determining the pressure inside the storage vessel;

a controller operatively associated with the heating device for adjusting a pressure in the storage vessel by controlling temperature within the storage vessel; and at least one thruster component selected from the group consisting of a main thruster, a neutralizing cathode, and a discharge cathode;

wherein a fluid passageway is provided from the adsorbent storage vessel to the at least one thruster component.

* * * * *